US005947780A

United States Patent [19]

Kellner et al.

[11] Patent Number: 5,947,780

[45] Date of Patent: Sep. 7, 1999

[54] APPARATUS FOR MARKING A SPOT IN DIFFERING DEPTHS OF WATER

[75] Inventors: Ronald E. Kellner, Seminole; Michael D. Conte, St. Petersburg, both of Fla.

[73] Assignee: Marksall Company, Largo, Fla.

[21] Appl. No.: 09/079,458

[22] Filed: May 15, 1998

[51] Int. Cl.[6] ..... B63B 22/16

[52] U.S. Cl. ..... 441/6; 441/26

[58] Field of Search ..... 441/1, 6, 21, 23, 441/24, 25, 26, 28; 33/720, 719, 722

[56] References Cited

U.S. PATENT DOCUMENTS

| | | | |
|---|---|---|---|
| 5,360,359 | 11/1994 | Reynolds | 441/26 |
| 5,376,035 | 12/1994 | Forrest | 441/26 |
| 5,449,308 | 9/1995 | Thompson | 441/26 |

*Primary Examiner*—Stephen Avila
*Attorney, Agent, or Firm*—Stanley M. Miller

[57] ABSTRACT

A marker for use by boaters to mark spots in a body of water includes a water-tight, hollow cylindrical main body that floats and which serves as a buoy member. The main body is capped at its opposite ends by end caps that are apertured. An elongate hollow tube is positioned within the hollow interior of the cylindrical main body so that it extends between the apertures. A spool member having a preselected length of line coiled thereabout is rotatably mounted atop the upper end cap and line extends from the spool through the interior of the hollow tube to the bottom of the body of water when the marker is in use, there being a weight at the free end of the line. Beads of progressively larger size relative to the free end of the line are secured to the line, each bead being positioned at a preselected length of the line that represents a particular water depth. A slide plate is slidably mounted to the bottom end cap in alignment with the hollow interior of the tube and bores of differing sizes are formed in the slide plate, each size corresponding to a bead and being slightly smaller than its corresponding bead to prevent its passage through the slide plate. The user aligns a preselected bore, representing a known water depth, with the hollow interior of the tube and unreels the line until a bead is stopped from passing through its associated bore.

12 Claims, 2 Drawing Sheets

APPARATUS FOR MARKING A SPOT IN DIFFERING DEPTHS OF WATER

BACKGROUND OF THE INVENTION

1. Field of the Invention

This invention relates, generally, to an apparatus useful to boaters such as fishermen and divers in marking certain spots in bodies of water with a marker. More particularly, it relates to a mechanical device that facilitates spot-marking in various known depths of water.

2. Description of the Prior Art

When a fisherman or diver finds a good spot for fishing or diving, the common practice in marking the spot is to attach a weighted line to an air-filled jug. The jug serves as a buoy, and the weight at the end of the line serves as an anchor means that prevents the line from drifting.

The length of the line attached to the jug is known. If the boater determines that the water is deeper than the length of the line, more line must be added. If the water is shallower than the length of the line, then removal of some of the line is required. This need to add or remove line renders the jug and line technique somewhat unsatisfactory.

Another shortcoming of using a jug and a line is that the line must be reeled in by hand when the marker is no longer needed.

What is needed, then, is a marker that can mark a spot in a body of water over a wide range of depths. The marker should not require the user to add or remove line as the water depth changes. Moreover, an improved marker should be provided that does not require hand-reeling of the deployed line.

However, in view of the art considered as a whole at the time the present invention was made, it was not obvious to those of ordinary skill in this art how the shortcomings of the known techniques could be overcome.

SUMMARY OF THE INVENTION

The long-standing but heretofore unfulfilled need for an apparatus that overcomes the limitations of the prior art is now met by a new, useful, and nonobvious invention. The present invention provides a buoyant marker that floats in a body of water and that marks a preselected spot in the body of water. It includes an elongate hollow main body and a pair of end caps that close opposite ends of the hollow main body. An aperture is formed in each of the end caps.

A spool means is rotatably mounted to a first end cap of the pair of end caps, and a preselected length of line is disposed in coiled relation to the spool means. A weight means is secured to a free end of the line.

An elongate tube is positioned within a hollow interior of the main body; the elongate tube extends between the apertures formed in the end caps.

A plurality of bead means are secured to the line at spaced intervals along the extent thereof. Each respective bead means progressively increases in size as their respective distances from the weight means increases.

A plate means has a plurality of bores of differing breadths formed therein. Each bore is associated with a predetermined length of line corresponding to a water depth, and each bore has a breadth lightly smaller than its associated bead means so that a bead means associated with a bore cannot pass therethrough.

The plate means is mounted for movement relative to a second end cap of the pair of end caps so that the bores are selectively positionable into alignment with the elongate tube.

Accordingly, moving the plate means to align a preselected bore formed in the plate means with a hollow interior of the elongate tube and unreeling the line from the spool means until a bead means is unable to pass through the preselected bore results in unreeling a predetermined length of line from the spool means, said predetermined length corresponding to a known water depth.

It is a primary object of this invention to provide a marker capable of marking spots in a body of water over a wide range of depths.

Another object is to provide such a marker that never requires addition or removal of line.

Still another object is to provide a marker that obviates the need to manually reel in a deployed line.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
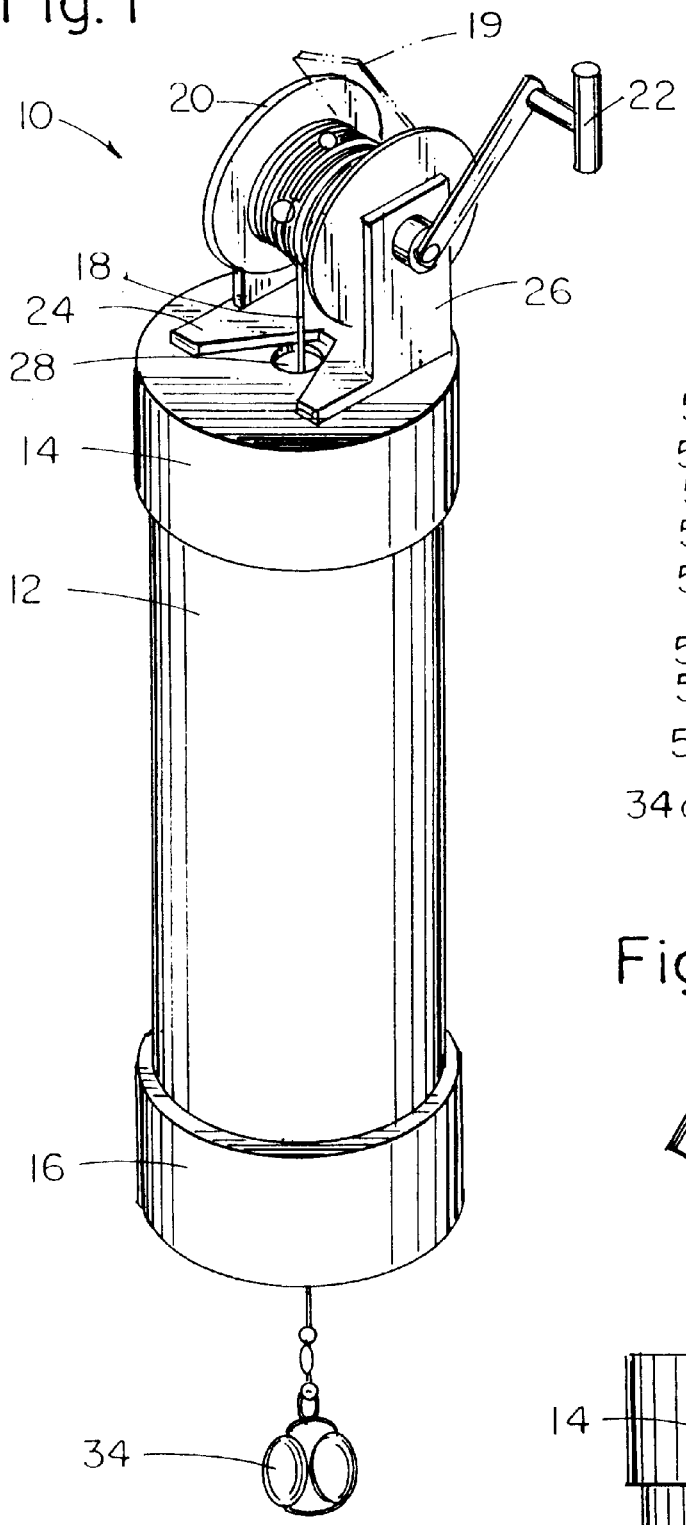
FIG. 1 is a perspective view of the novel marker.

Referring now to FIG. 1, it will there be seen that an exemplary embodiment of the invention is denoted as a whole by the reference numeral 10.

Hollow, air-containing, buoyant and water-tight cylindrical main body 12 is capped against leakage at its upper and lower ends by end caps 14, 16, respectively. An elongate length of line 18 is reeled about spool means 20 having a crank handle 22; spool means 20 is rotatably mounted between a pair of upstanding brackets 24, 26 that are fixedly secured by suitable means to top end cap 14.

Figure 2:
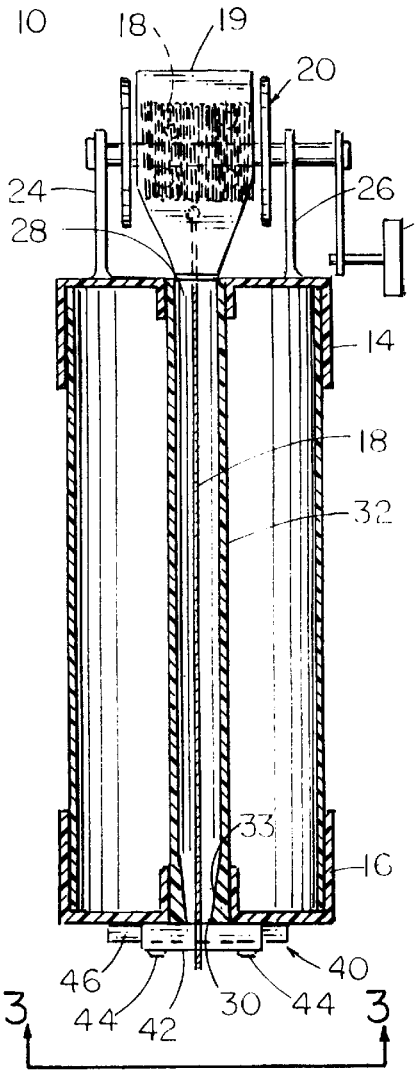
FIG. 2 is a side elevational, partly sectional view of the structure depicted in FIG. 1.

As best understood in connection with FIG. 2, end caps 14, 16 are centrally apertured as at 28, 30, and an elongate, upstanding imperforate rigid tube 32 extends between said apertures, in concentric relation to a longitudinal axis of symmetry of said main body, to provide a housing for line 18 when it is unspooled. In this way, water in tube 32 cannot enter into hollow cylindrical main body 12, and line 18 may be coiled and uncoiled with respect to spool means 20 without interference from said cylindrical main body 12.

End caps 14, 16 and elongate tube 32 could be integrally formed with main body 12; in the claims that follow, reference to said end caps and said tube includes such integrally formed, equivalent counterparts.

Figure 1A:
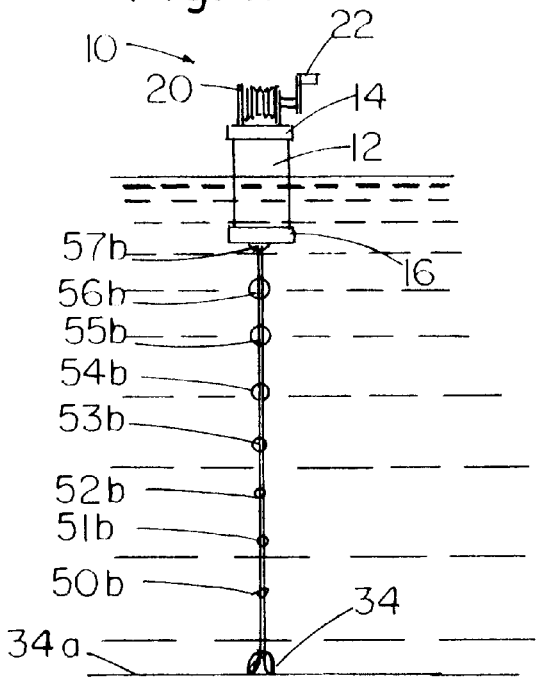
FIG. 1A is a diagrammatic view depicting the marker of FIG. 1 when floating in a body of water and marking a spot on the surface thereof.

As best understood in connection with FIGS. 1 and 1A, a weight means 34 is secured to the free end of line 18 and said weight means rests atop a riverbed, seabed, lakebed, or the like 34*a* when marker 10 is in use. Note that line 18 is straight when marker 10 is properly used, i.e., its length substantially matches the depth of the body of water so that marker 10 does not drift away from the spot being marked.

Figure 3:
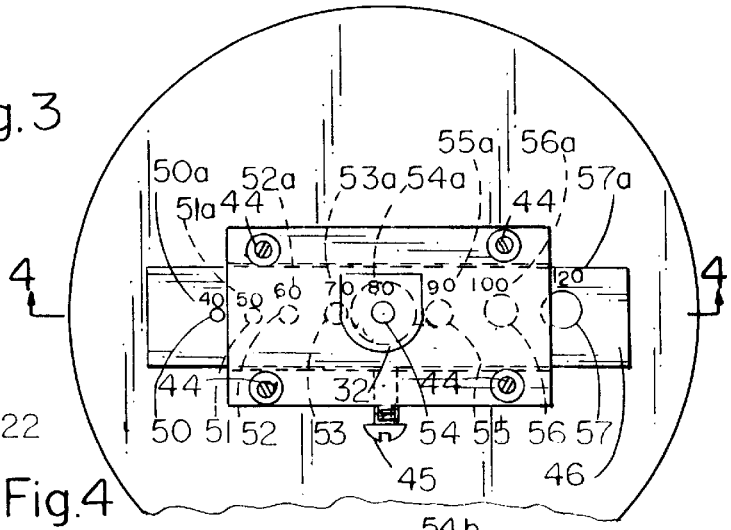
FIG. 3 is a bottom view of the novel marker.
Figure 4:
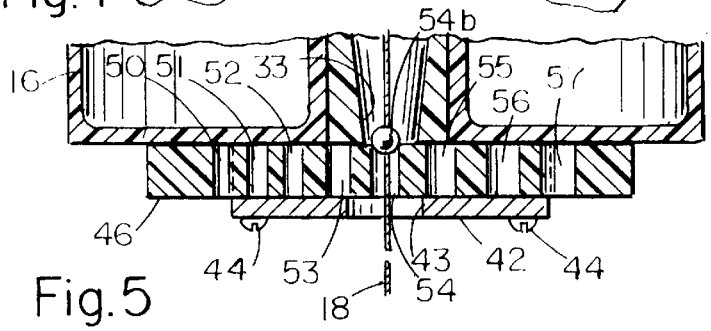
FIG. 4 is a sectional view taken along line 4—4 in FIG. 3.
Figure 5:
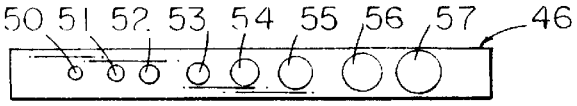
FIG. 5 is a plan view of a slidably mounted indexing member that forms a part of the novel construction.

FIG. 2 depicts an assembly 40 that is mounted to bottom end cap 16, but the structure of assembly 40 is best depicted in FIGS. 3–5. More particularly, a mounting plate 42 is secured in spaced apart relation to said bottom end cap 16 by a plurality of screws, collectively denoted 44, and a slide bar 46 is slidably mounted between said end cap and said mounting plate. A set screw 45 is received within a bore formed in mounting plate 42 and bears against slide bar 46 to prevent sliding movement thereof when a given setting is to be locked into place. An aperture 43 is formed mid-length of said fixed position mounting plate. A plurality of throughbores are formed in slide bar 46, each of said throughbores being centered on a longitudinal axis of symmetry of said slide bar and each of said throughbores being longitudinally spaced apart from one another along the extent of said slide bar. Bore 50, in this particular embodiment, has a first predetermined diameter, bore 51 has a second predetermined diameter that is greater than said first predetermined diameter, and so on, i.e., the successive bores increase in diameter, bore 57 being the largest-in-diameter of bores 50–57. It should be clear that a greater or lesser number of bores is within the scope of this invention.

In this way, any of the throughbores 50–57 may be brought into alignment with the hollow interior of elongate tube 32 simply by manually sliding plate 46 until a preselected bore is in said alignment. Each bore, in this particular example, is labeled by a suitable indicia means as at 50*a*, 51*a*, 52*a*, 53*a*, 54*a*, 55*a*, 56*a* and 57*a*, with the depth, in feet, that is marked when a preselected bore is in alignment with said hollow interior of tube 32. As depicted in FIGS. 3 and 4, bore 54 marked "80 feet" as at 54*a* is in alignment with said hollow interior. Accordingly, it is understood that each bore represents a preselected length of deployed line or a preselected water depth.

Referring again to FIG. 1A, it will there be seen that a plurality of beads, denoted 50*b*, 51*b*, etc., are firmly secured to line 18 at predetermined spaced intervals along its length. Each bead or other bead means has a diameter, size, or breadth slightly greater than the breadth of its associated throughbore so that it cannot pass therethrough. Beginning at the free end of line 18, i.e., at the weight 34 end thereof, each bead is progressively smaller in diameter than its preceding bead, i.e., lowermost bead 50*b* is smaller in diameter than bead 51*b*, and so on. In the example configuration of FIG. 1A, the water depth is 120 feet and bore 57 is in alignment with tube 32 so that the largest in diameter bead 57*b* is prevented from passing through said bore 57, thereby preventing further unreeling of line 18 from spool 20. If the fisherman or diver then finds another spot desired to be marked that is only eighty feet in depth, line 18 is fully retracted by cranking crank handle 22, slide plate 46 is slidably displaced until bore 54 is in alignment with tube 32, as depicted in FIG. 3, and weight means 34 is lowered by cranking handle 22 in the opposite direction to lower the weight. Bead 54*b* is not able to pass through bore 54, thereby ensuring that only eighty feet of line is unreeled from spool means 20.

Although the exemplary embodiment of FIG. 3 provides for marking spots in water ranging from a depth of forty feet to a depth of one hundred twenty feet, it should be understood that the same principle may be applied to provide lesser or greater ranges. For example, beginning with a ninety foot line would provide a marker having a range of 10–90 feet.

Figure 6:
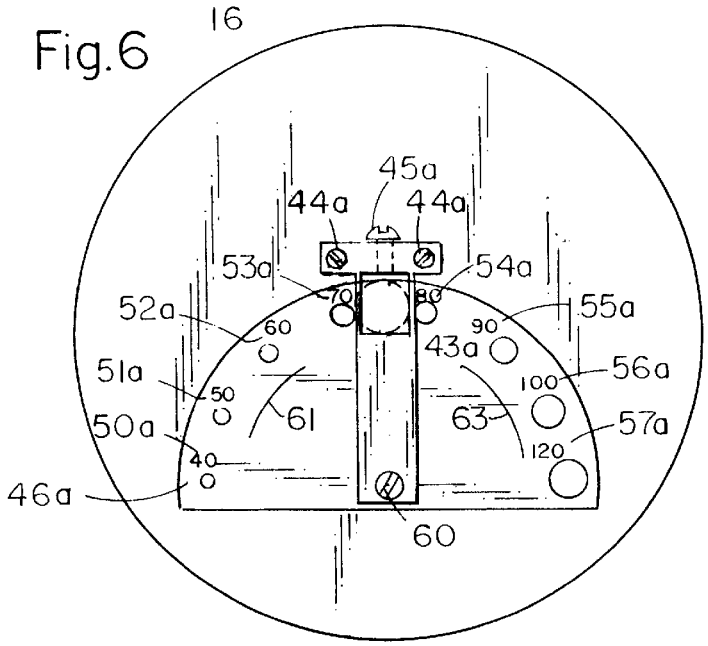
FIG. 6 is a bottom view of an alternate embodiment.

In a second embodiment of the invention, depicted in FIG. 6, slide plate 46 is provided in the form of a semicircular dial 46*a* and bores 51–57 are equidistantly spaced apart from one another in an arcuate array. Dial 46*a* is pivotally mounted about a pivot pin means 60, which may be provided in the form of a tool-engageable screw as depicted, for selective pivotal movement in opposite directions as indicated by directional arrows 61, 63. Dial 46*a* is sandwiched between bottom end plate 16 and mounting plate 42*a* which is mounted in spaced apart relation to said bottom end plate by screws collectively denoted 44*a*. Aperture 43*a* is formed in said fixed position mounting plate 42*a* and is in alignment with the interior of hollow tube 32. A set screw 45*a* may be employed to lock dial 46*a* against pivotal movement when a desired setting has been made.

The operation of the second embodiment is essentially the same as the operation of the first, i.e., dial 46*a* is rotated until the desired bore indicating the depth of the water is in alignment with tube 32, and line 18 is unreeled until a bead cannot pass through the selected bore, thereby preventing further deployment of the line.

Other means for bringing the bores of various diameter into alignment with the hollow interior of tube 32 are within the scope of the invention. A skilled machine designer, after seeing the means of FIGS. 3 and 6, will be able to devise at least a few other ways of performing the same job, and all such alternative means are therefore within the scope of this invention.

Figure 1B:
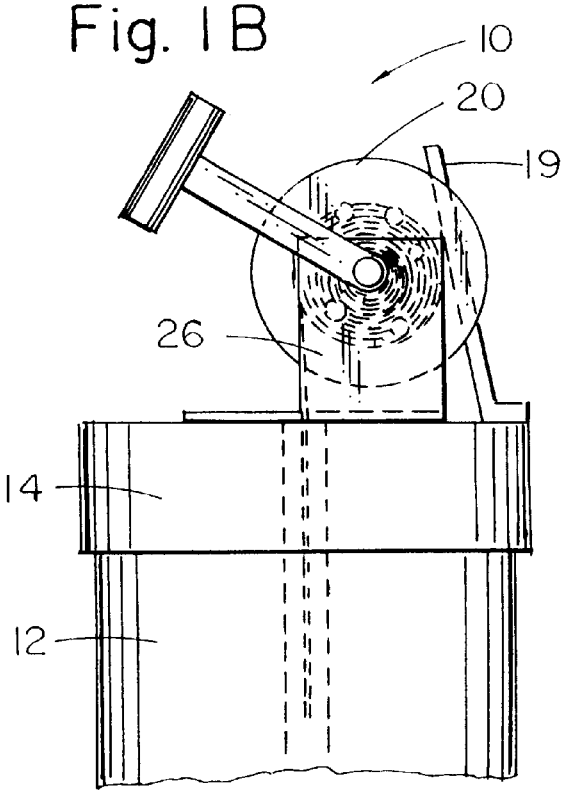
FIG. 1B is a side elevational view depicting a backlash-inhibiting means.

A plastic flap 19 (see FIGS. 1B and 2), may be added to inhibit backlash of line 18 if it is released rapidly. Flap 19 is flexible but sufficiently rigid to continuously bear against line 18 as it is spooled and unspooled, and performs a function much like a fisherman's thumb that bears lightly against a coiled fishing line as it is cast when a rod and reel is employed. The bottom end of flap 19 is mounted to upper end cap 14 by any suitable means and the free end of said flap continuously bears against the line coiled about spool means 20.

Marker 10, to be sold commercially under the trademark MARKS ALL spot marker is inexpensive to manufacture and is thus affordable by consumers. It solves the problems associated with the spot-marking means of the prior art in an elegant way and accordingly represents a significant contribution to the art.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A buoyant marker that floats in a body of water and that marks a preselected spot in said body of water, comprising:

an elongate hollow main body;

a pair of end caps that close opposite ends of said main body;

an aperture formed in each of said end caps;

a spool means rotatably mounted to a first end cap of said pair of end caps;

a preselected length of line disposed in coiled relation to said spool means;

a weight means secured to a free end of said line;

an elongate tube positioned within a hollow interior of said main body, said elongate tube extending between said apertures;

a plurality of bead means secured to said line at spaced intervals along the extent thereof, each respective bead means progressively increasing in size as their respective distances from said weight means increases;

a plate means having a plurality of bores of differing breadths formed therein, each bore being associated with a predetermined length of line corresponding to a water depth, each bore having a breadth slightly smaller than its associated bead means so that a bead means associated with a bore cannot pass therethrough;

said plate means mounted for movement relative to a second of said end caps so that said bores are selectively positionable into alignment with said tube;

whereby moving said plate means to align a preselected bore formed in said plate means with a hollow interior of said tube and unreeling said line from said spool means until a bead means is unable to pass through the preselected bore results in unreeling a predetermined length of line from said spool means, said predetermined length corresponding to a known water depth.

2. The marker of claim 1, further comprising a mounting means fixedly secured to a second end cap of said pair of end caps, said second end cap being positioned at a lowermost end of said main body when said main body is floatably deployed in a body of water, said plate means being mounted for movement between said second end cap and said mounting plate, and said mounting plate being apertured to permit extension of said line therethrough when said line is deployed.

3. The marker of claim 2, wherein said mounting means is a flat mounting plate and further comprising a set screw that extends through a bore formed within said mounting plate and which has a leading end that bears against said plate means to hold it into a preselected position when said set screw is advanced.

4. The marker of claim 2, further comprising indicia means associated with each of said bores for indicating a water depth represented by each of said bores.

5. The marker of claim 3, wherein said plate means is an elongate flat plate and wherein said plurality of bores formed in said flat plate are in longitudinal alignment with one another so that positioning a preselected bore into alignment with the hollow interior of said elongate tube is accomplished by sliding said plate means with respect to said elongate tube until a preselected bore means, identified by its associated indicia means, is aligned with said hollow interior of said elongate tube.

6. The marker of claim 3, wherein said plate means is a semicircular-in-configuration dial member that is pivotally mounted with respect to said second end plate and which is positioned between said end plate and said mounting means, and wherein said bore means are arrayed in an arcuate array adjacent an arcuate peripheral edge of said dial member.

7. The marker of claim 6, wherein said mounting means is a flat mounting plate having an aperture formed therein that is in alignment with the hollow interior of said elongate tube so that alignment of a preselected bore with said aperture and hence said hollow interior of said elongate tube is accomplished by pivoting said dial until said preselected bore is in said alignment with said aperture.

8. The marker of claim 7, further comprising a set screw extending through a bore formed in said mounting plate and having a leading end that bears against a peripheral edge of said dial when said dial is locked into a preselected position.

9. The marker of claim 1, further comprising a crank handle secured to said spool means to facilitate unspooling and spooling of said line.

10. The marker of claim 1, wherein said respective apertures formed in said end caps are central apertures and wherein said elongate tube is positioned concentrically within said hollow tube with respect to a longitudinal axis thereof so that it extends between said central apertures.

11. The marker of claim 9, further comprising a flap means that continuously bears against line that is coiled about said spool means to inhibit backlashing of said line when said line is released.

12. The marker of claim 11, wherein said flap means is a flat plastic flap having a bottom end secured to an upper end cap of said pair of end caps and having a free upper end that continuously bears against said line that is coiled about said spool means.

* * * * *